US007156162B2

(12) United States Patent
Manaka

(10) Patent No.: US 7,156,162 B2
(45) Date of Patent: Jan. 2, 2007

(54) UNIT-TYPE HEAT EXCHANGER

(75) Inventor: Hideaki Manaka, Oyama (JP)

(73) Assignee: Showa Denko K.K., Tokyo (JP)

( * ) Notice: Subject to any disclaimer, the term of this patent is extended or adjusted under 35 U.S.C. 154(b) by 0 days.

(21) Appl. No.: 10/516,933

(22) PCT Filed: Jun. 17, 2003

(86) PCT No.: PCT/JP03/07638

§ 371 (c)(1),
(2), (4) Date: Dec. 14, 2004

(87) PCT Pub. No.: WO03/106910

PCT Pub. Date: Dec. 24, 2003

(65) Prior Publication Data

US 2005/0217831 A1 Oct. 6, 2005

Related U.S. Application Data

(60) Provisional application No. 60/394,879, filed on Jul. 11, 2002.

(30) Foreign Application Priority Data

Jun. 18, 2002 (JP) ..... 2002-176896

(51) Int. Cl.
*F28D 1/053* (2006.01)

(52) U.S. Cl. ..... 165/140; 165/150; 165/151

(58) Field of Classification Search ..... 165/140, 165/67, 149–152
See application file for complete search history.

(56) References Cited

U.S. PATENT DOCUMENTS 6,073,686 A * 6/2000 Park et al. ..... 165/152
6,675,879 B1 * 1/2004 Voss ..... 165/140
6,779,591 B1 * 8/2004 Ehlers et al. ..... 165/140
2004/0069446 A1 * 4/2004 Horiuchi ..... 165/140

FOREIGN PATENT DOCUMENTS

| | | | |
|---|---|---|---|
| EP | 0789213 | | 8/1997 |
| JP | 74970/1988 | | 5/1988 |
| JP | 38565/1991 | | 4/1991 |
| JP | 10-2693 | * | 1/1998 |

* cited by examiner

*Primary Examiner*—Teresa J. Walberg
(74) *Attorney, Agent, or Firm*—Oblon, Spivak, McClelland, Maier & Neustadt, P.C.

(57) ABSTRACT

A unit-type heat exchanger for use as a condenser in motor vehicle air conditioners and an oil cooler for various oils use in motor vehicles. An oil cooler 1 and a condenser 2 are arranged one above the other and assembled into a unit. Each of these components 1, 2 has two pipelike headers 10, 20 arranged in parallel to each other at a spacing, and a plurality of parallel exchange tubes 11, 21 joined at opposite ends thereof to the two headers 10, 20. The adjacent oil cooler 1 and condenser 2 have ends thereof positioned in proximity to each other and connected to each other by connectors 3. Each of the connectors 3 is provide at opposite sides thereof with respective recessed portions 30, 31 for opposed ends of the headers 10, 20 to be fitted therein, and these header ends are fited in the respective recessed portions 30, 31 and joined to the connector 3. The unit-type heat exchanger is adapted to prevent mixing of the fluids flowing inside the oil cooler 1 and the condenser 2, respectively.

49 Claims, 10 Drawing Sheets

UNIT-TYPE HEAT EXCHANGER

CROSS REFERENCE TO RELATED APPLICATIONS

This application is an application filed under 35 U.S.C. §111(a) claiming the benefit pursuant to 35 U.S.C. §119(e)(1) of the filing date of Provisional Application No. 60/394,879 filed Jul. 11, 2002 pursuant to 35 U.S.C. §111(b).

TECHNICAL FIELD

The present invention relates to unit-type heat exchangers comprising a plurality of heat exchange portions each having two pipelike headers arranged in parallel to each other at a spacing and a plurality of parallel heat exchange tubes joined at opposite ends thereof to the two headers, the heat exchange portions being arranged longitudinally of the headers and assembled into a unit.

The term "aluminum" as used herein includes aluminum alloys in addition to pure aluminum.

BACKGROUND ART

Various heat exchangers are mounted on vehicles such as motor vehicles. To obtain a comfortable space in motor vehicles, an enlarged passenger compartment must be made available, with the inevitable result that the space usable for installing a heat exchanger or like component becomes limited. For this reason, a reduced size and a smaller weight are required of heat exchangers, while a simplified procedure is needed also for installing the heat exchanger in motor vehicles.

In order to fulfill these requirements, heat exchangers of the unit type are known which comprise, for example, a condenser for motor vehicle air conditioners and an oil cooler which are assembled into a unit (see, for example, JP, U No. 6-4218 and JP, A No. 9-152296). The oil cooler is used for cooling an oil for use in the engine, power steering device, automatic transmission or the like.

The unit-type heat exchanger disclosed in JP, U No. 6-4218 comprises two pipelike headers arranged in parallel to each other at a spacing, a plurality of parallel heat exchange tubes joined at opposite ends thereof to the headers, and a partition plate provided in each of the headers for dividing the interior of the header into a condenser header portion and an oil cooler header portion. The partition plate is inserted into the header through an insertion hole formed in the peripheral wall of the header and brazed to the header.

However, if the unit-type heat exchanger has a faulty brazed joint between the partition plate and the header, there arises the problem that the oil of the oil cooler becomes mixed with the refrigerant of the condenser to impair the performance of the heat exchange cycle including the condenser, or that the refrigerant of the condenser becomes mixed with the oil of the oil cooler to adversely influence the performance of the device for which the oil is used.

The unit-type heat exchanger disclosed in JP, A No. 9-152296 comprises two pipelike headers arranged in parallel to each other at a spacing, a plurality of parallel heat exchange tubes each having opposite ends joined to the respective headers, and two partition plates arranged as spaced apart from each other in each of the headers and brazed to the header for dividing the interior of the header into a condenser header portion and an oil cooler header portion. The peripheral wall of each of the headers is provided with a monitoring hole at a portion thereof corresponding to the space between the two partition plates for discharging therethrough a fluid leaking through the partition plates to the outside of the header.

If the unit-type heat exchanger has a faulty brazed joint between the partition plate and the header, the oil leaking from the oil cooler or the refrigerant leaking from the condenser will be drained from the space through the monitoring hole, whereas the arrangement can not completely prevent the oil from becoming mixed with the refrigerant of the condenser or the refrigerant from becoming mixed with the oil of the oil cooler. Thus, the same problem as encountered with the unit-type heat exchanger disclosed in JP, U No. 6-4218 is also experienced. Moreover, water will ingress into the header through the monitoring hole and is therefore likely to render the header susceptible to corrosion.

An object of the present invention is to overcome the above problems and to provide a unit-type heat exchanger wherein fluids flowing through adjacent two heat exchange portions can be prevented from mixing.

DISCLOSURE OF THE INVENTION

The present invention provides a unit-type heat exchangers comprising a plurality of heat exchange portions each having two pipelike headers arranged in parallel to each other at a spacing and a plurality of parallel heat exchange tubes joined at opposite ends thereof to the two headers, the heat exchange portions being arranged longitudinally of the headers and assembled into a unit, the two headers of the pair adjacent heat exchange portions having ends thereof positioned in proximity to each other and connected to each other by a connector, the connector being provided at opposite sides thereof with respective recessed portions for said ends of the headers to be fitted therein, said header ends being fitted in the respective recessed portions and joined to the connector.

With the unit-type heat exchanger of the present invention, the two headers of the adjacent heat exchange portions have their adjacent ends fitted in the respective recessed portions of the connector and joined to the connector, so that even if there is a faulty joint between the header and the connector, the different kinds of fluids flowing inside the adjacent heat exchange portions are prevented from becoming mixed with each other. This precludes the impairment of the performance of the heat exchange cycle including either one of the heat exchange portions or the impairment of the performance of the device for which the fluid flowing inside the heat exchange portion is used.

In the unit-type heat exchanger according to the invention, each of the opposite recessed portions of the connector may have a peripheral wall provided, at a location not interfering with the heat exchange tube, with a high portion greater than other portion thereof in height as measured from a bottom surface of the recessed portion. In this case, the high portion functions to prevent the header from falling down when the two headers are joined to the connector. The portion of the peripheral wall of each recessed portion at one side thereof where the heat exchange tube is positioned can be given a smaller height. This prevents the interference of each of the adjacent heat exchange tubes of the heat exchange portions with the connector. The unit-type heat exchanger can therefore be assembled without a reduction in work efficiency.

In the unit-type heat exchanger of the invention, the high portion of the peripheral wall of the connector recessed portion may have a height of at least 10 mm as measured from the bottom surface of the recessed portion. The header can then be prevented from falling down more effectively when the two headers are joined to the connector.

In the unit-type heat exchanger according to the invention, the low portion of the peripheral wall of the connector recessed portion may have a height of at least 5 mm as measured from the bottom surface of the recessed portion. The different fluids flowing inside the adjacent heat exchange portions can then be effectively prevented from becoming mixed.

With the unit-type heat exchanger according to the invention, the high portion of the peripheral wall of the connector recessed portion may have opposite edges which are positioned symmetrically about a horizontal plane extending through the center line of the recessed portion and extending longitudinally of the heat exchange tube, and lines connecting the center line of the recessed portion to the opposite edges may make an angle of 180 deg therebetween. The header can then be prevented from falling down when the two headers are joined to the connector.

With unit-type heat exchanger according to the invention, the high portion of the peripheral wall of the connector recessed portion may have opposite edges which are positioned symmetrically about a horizontal plane extending through the center line of the recessed portion and extending longitudinally of the heat exchange tube, and lines connecting the center line of the recessed portion to the opposite edges may make an angle of 120 deg therebetween. The header can then be prevented from falling down more effectively when the two headers are joined to the connector.

In the unit-type heat exchanger according to the invention, the opposite recessed portions of the connector may be different in size, with the headers of the adjacent heat exchange portions differing in cross sectional size. The headers can then be optimized in cross sectional area for the heat exchange portions to exhibit satisfactory performance.

With the unit-type heat exchanger according to the invention, center lines of the opposite recessed portions of the connector may be out of alignment with each other, with center lines of the headers of the adjacent heat exchange portions out of alignment with each other. The adjacent two heat exchange portions can then be positioned as shifted from each other with respect to the direction of flow of air, or with respect to the longitudinal direction of the heat exchange tubes. This ensures effective use of the space available within the vehicle or industrial machine in which the unit-type heat exchanger is to be installed.

With the unit-type heat exchanger according to the invention, each of the recessed portions of the connector may have a projection formed on an inner peripheral surface thereof, and a peripheral wall of each of the headers may have a cutout formed in an end portion thereof for the projection to fit in. The header can then be accurately positioned relative to the connector when the header is to be joined to the connector.

In an embodiment of unit-type heat exchanger according to the invention, a fin is disposed in an air passing space between each pair of adjacent heat exchange tubes, and a separating plate is disposed between the two heat exchange tubes of the adjacent heat exchange portions which tubes are positioned at respective ends thereof immediately adjacent to the connector, the separating plate being parallel to and being spaced apart from said two heat exchange tubes, a fin being provided between the separating plate and each of said two heat exchange tubes. In this case, the space between the adjacent two heat exchange portions can be effectively used for heat exchange. By suitably adjusting the thickness and number of separating plates, the spacing between the heat exchange tube at the connector-side end of one of the heat exchange portions and the heat exchange tube at the connector-side end of the other heat exchange portion can be divided into at least two spacings equal to the spacing between the adjacent heat exchange tubes of each heat exchange portion. This makes it possible to use the fin of at least one of the adjacent two heat exchange portions as the fins to be disposed in the spaces between the separating plate and the end heat exchange tubes, consequently eliminating the need to prepare another kind of fins for specific use. The heat of the fluid flowing inside the heat exchange tube at the connector-side end of one of the adjacent two heat exchange portions and the heat of the other fluid flowing inside the heat exchange tube at the connector-side end of the other heat exchange portion can be dissipated by the fins in the respective spaces between the separating plate and the end heat exchange tubes. This reduces the likelihood that each of the two heat exchange portions will be influenced by the heat of the other.

In the unit-type heat exchanger according to the invention, the separating plate may have opposite ends each in contact with the connector. When the headers, heat exchange tubes, fins and connectors are tacked before joining in fabricating the unit-type heat exchanger in this case, the assembly to be tacked will be subjected to a fastening force acting inward longitudinally of the heat exchange tubes. Even in such a situation, the adjacent headers as supported by the connector are prevented from falling down outward about the location of support by the connector.

In the unit-type heat exchanger according to the invention, the separating plate may have opposite end portions each tapered toward the connector with a deceasing width. Even when each end of the separating plate is in contact with the connector, the area of contact between the separating plate and the connector can be diminished in this case, with the result that water or the like that would cause corrosion is less likely to collect at the portion of contact between the two members.

In the unit-type heat exchanger according to the invention, the separating plate may have opposite end portions each provided with a protrusion on each of opposite surfaces thereof. When the headers, heat exchange tubes, fins, connectors and separating plates are tacked before joining in fabricating the unit-type heat exchanger in this case, the fin to be disposed between the heat exchange tube and the separating plate or between the separating plates will be held at its opposite ends between the protrusions of the separating plates. The fin is therefore held in place with an increased force, with its opposite end prevented from slipping off.

In the unit-type heat exchanger according to the invention, the separating plate may have a hole or cutout in a portion thereof other than opposite end portions thereof for reducing the area of contact of the plate with the fin. For example, the separating plate may be provided with a hole which is elongated longitudinally of the plate. The separating plate may have a plurality of holes elongated longitudinally of the plate and spaced apart widthwise of the plate. The separating plate may have a plurality of holes which are arranged in rows both longitudinally and widthwise of the plate. The separating plate may be provided in each of its opposite side edge portions with a plurality of cutouts arranged at a spacing longitudinally of the plate. In these cases, the area of contact between the fin and the separating plate diminishes to result in a decreased quantity of heat transfer between the two members. Accordingly, the heat of the fluid flowing inside the heat exchange tube at the connector-side end of one of the adjacent two heat exchange portions is less likely to be transferred to the fluid flowing inside the heat exchange tube at the connector-side end of the other heat exchange portion.

The unit-type heat exchanger according to the invention may comprise two heat exchange portions, one of the heat exchange portions being a condenser, the other heat exchange portion being an oil cooler.

The unit-type heat exchanger according to the invention may comprise three heat exchange portions, one of the heat exchange portions being a condenser, the other two heat exchange portion being oil coolers, the two oil coolers being used for cooling oils for different uses.

The unit-type heat exchanger described above is installed in vehicles, for example, in motor vehicles.

BEST MODE OF CARRYING OUT THE INVENTION

Figure 1:
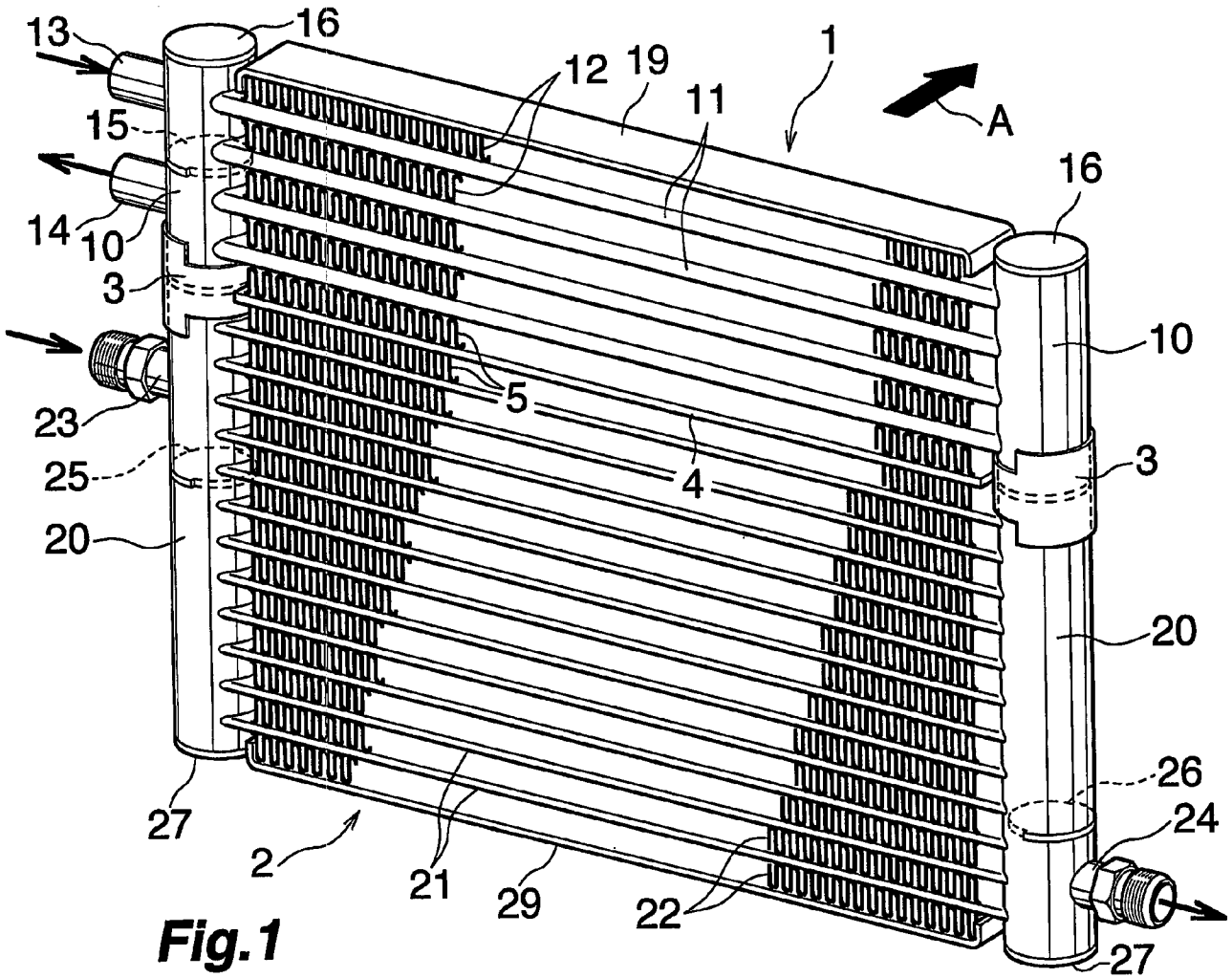
FIG. 1 is a perspective view showing the overall construction of an embodiment of unit-type heat exchanger according to the invention.

Embodiments of the present invention will be described below with reference to the drawings. Throughout the drawings, like parts are designated by like reference numerals and will not be described repeatedly.

Figure 2:
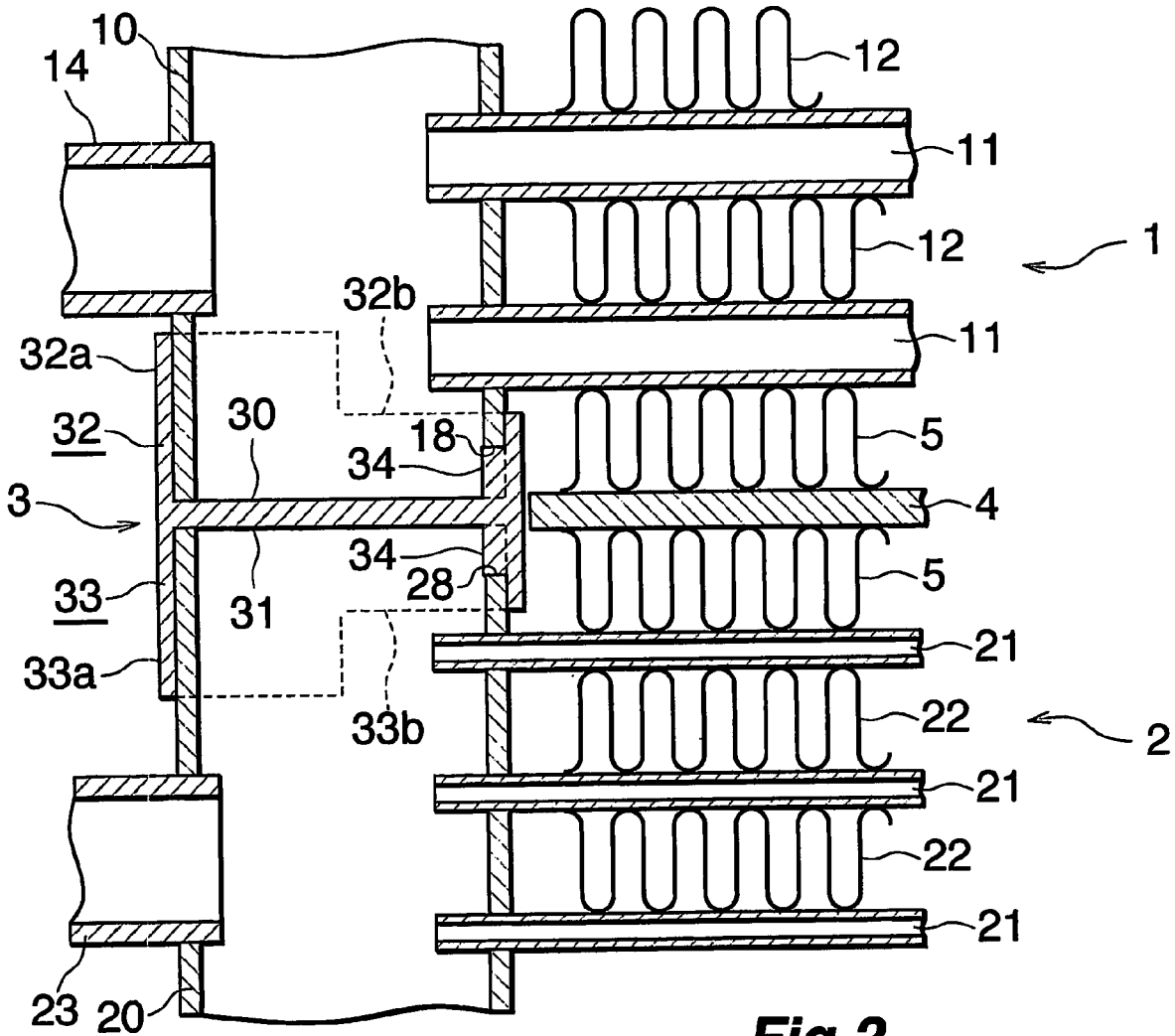
FIG. 2 is a view in vertical section and showing part of the heat exchanger of FIG. 1 on an enlarged scale.
Figure 3:
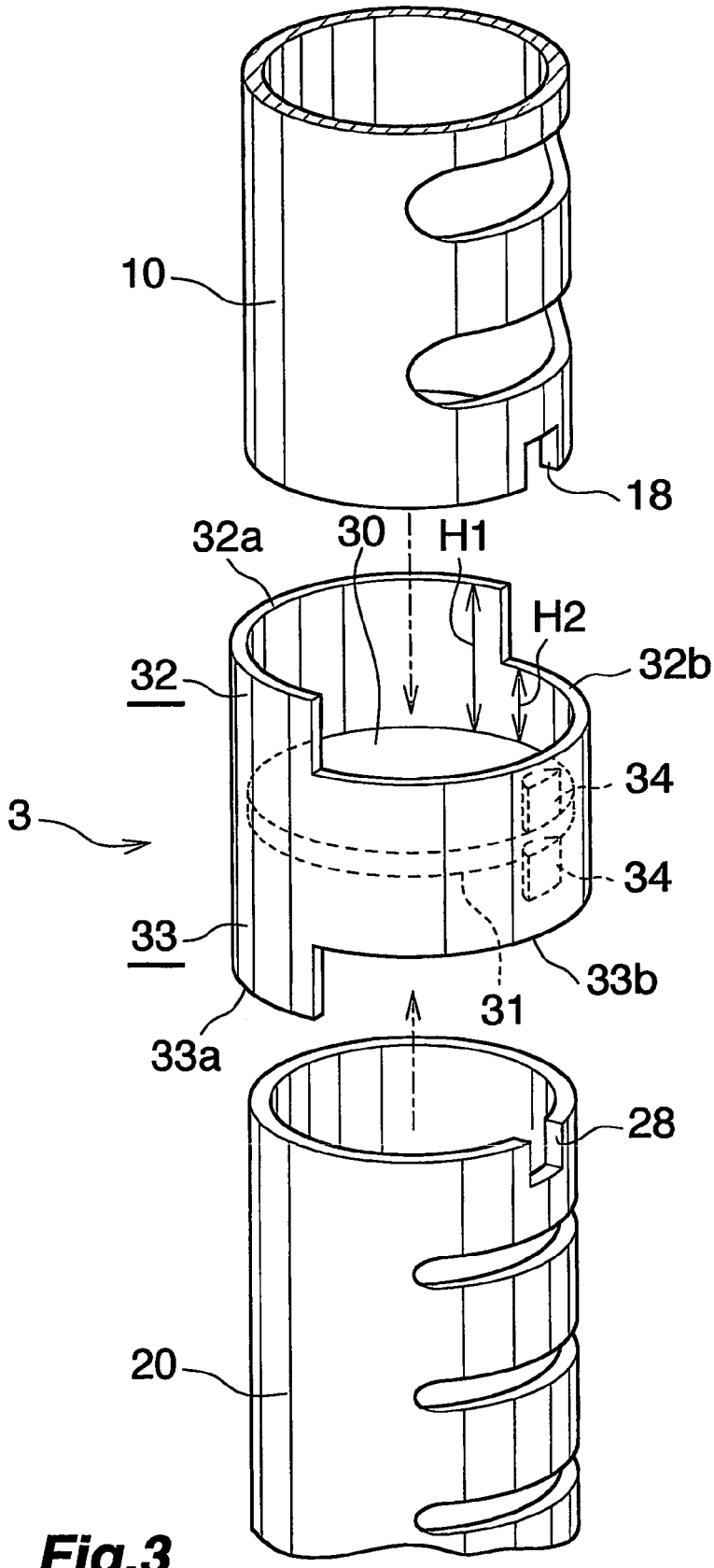
FIG. 3 is an enlarged fragmentary perspective view showing headers of the heat exchanger of FIG. 1 and a connector as disassembled.

FIG. 1 shows the overall construction of an embodiment of unit-type heat exchanger according to the invention, and FIGS. 2 and 3 are fragmentary views of the heat exchanger. In the following description, the upper and lower sides, and left- and right-hand sides of FIG. 1 will be referred to respectively as "upper," "lower," "left" and "right."

With reference to FIG. 1, the unit-type heat exchanger is adapted for use in motor vehicles, and comprises an oil cooler 1 and a condenser 2 for motor vehicle air conditioners which are provided in a vertical plane, with the former positioned above the latter.

The oil cooler 1 comprises two aluminum vertical headers 10 arranged in parallel as laterally spaced apart from each other, parallel aluminum flat heat exchange tubes 11 joined at opposite ends thereof to the two headers 10 by brazing, a corrugated aluminum fin 12 disposed in an air passing space between each pair of adjacent heat exchange tubes 11 and brazed to the tubes 11, an aluminum oil inlet pipe 13 joined to an upper portion of peripheral wall of the header 10 at the left side by brazing, an aluminum oil outlet pipe 14 similarly joined to a lower portion of peripheral wall of the left header 10 by brazing, and an aluminum partition plate 15 provided at the midportion of interior of the left header 10. The heat exchange tubes 11 positioned above the partition plate 15 and the heat exchange tubes 11 positioned below the partition plate 15 provide respective groups of channels. An oil having a high temperature and flowing in through the oil inlet pipe 13 flows through the oil cooler 1 via the channel groups in a hairpin pattern until the oil flows out of the oil outlet pipe 14, as cooled to a low temperature.

The condenser 2 comprises two aluminum vertical headers 20 arranged in parallel as laterally spaced apart from each other, parallel aluminum flat heat exchange tubes 21 joined at opposite ends thereof to the two headers 20 by brazing, a corrugated aluminum fin 22 disposed in an air passing space between each pair of adjacent heat exchange tubes 21 and brazed to the tubes 21, an aluminum refrigerant inlet pipe 23 joined to an upper end portion of peripheral wall of the header 20 at the left side by brazing, an aluminum refrigerant outlet pipe 24 joined to a lower end portion of peripheral wall of the header 20 at the right side by brazing, and a first aluminum partition plate 25 provided above the midportion of interior of the left header 20 and a second aluminum partition plate 26 provided below the midportion of interior of the right header 20. The number of heat exchange tubes 21 positioned above the first partition plate 25, the number of heat exchange tubes 21 between the first partition plate 25 and the second partition plate 26, and the number of heat exchange tubes 21 positioned below the second partition plate 26 gradually decrease from above downward to provide groups of channels. A refrigerant in a vapor phase flowing in through the refrigerant inlet pipe 23 flows through the condenser 2 zigzag via the channel groups until the refrigerant flows out of the refrigerant outlet pipe 24 in a liquid phase.

Although the cross sectional shape of the headers 10, 20 of the oil cooler 1 and the condenser 2 can be determined as desired, the headers of this embodiment are all circular in cross section.

In the oil cooler 1 and condenser 2, each of the partition plates 15, 25, 26 is inserted into the header 10 or 20 through an insertion hole formed in the peripheral wall of the header 10 or 20 and brazed to the header 10 or 20. The upper end openings of the two headers 10 of the oil cooler 1 and the lower end openings of the two headers 20 of the condenser 2 are closed with aluminum lids 16, 27 brazed to the headers 10, 20, respectively.

The left headers 10, 20 of the oil cooler 1 and the condenser 2, as well as the right headers 10, 20 thereof, are connected to each other by a connector 3. The lower end openings of the two headers 10 of the oil cooler 1 and the upper end openings of the two headers 20 of the condenser 2 are each closed with the connector 3.

With reference to FIGS. 2 and 3, the connector 3 is made from aluminum, for example, by forging, and has header fitting recessed portions 30, 31 respectively at the upper and lower sides. The shape and size of the upper recessed portion 30 as seen from the side of the header 10, i.e., from above, match the shape and size of the cross section of the header 10 of the oil cooler 1. The shape and size of the lower recessed portion 31 as seen from the side of the header 20, i.e., from below, match the shape and size of the cross section of the header 20 of the condenser 2. The headers 10, 20 are circular in cross sectional shape according to the present embodiment, so that the recessed portions 30, 31 as seen from the respective sides of the headers 10, 20 are circular and have a size in match with the size of cross section of the headers 10, 20. Accordingly the recessed portions 30, 31 are each in the form of a bottomed hollow cylinder.

The lower end of the header 10 of the oil cooler 1 is fitted into the upper recessed portion 30, and the upper end of the header 20 of the condenser 2 into the lower recessed portion 31, and these ends are brazed to the connector 3. The oil cooler header 10 and the condenser header 20 have their center lines aligned with each other, and are equal in outside diameter, so that the inner peripheral surfaces of the two recessed portions 30, 31 have their center lines aligned with each other and are equal in inside diameter.

The cylindrical peripheral walls 32, 33 of the recessed portions 30, 31 have laterally outer segmental cylindrical portions 32*a*, 33*a* which are higher than laterally inner segmental cylindrical portions 32*b*, 33*b* thereof. The higher segmental cylindrical portions 32*a*, 33*a* are semicircular when seen from above. Stated more specifically, the segmental cylindrical portions 32*a*, 33*a* have opposite edges which are positioned symmetrically about a horizontal plane extending through the center line of the recessed portions 30, 31 and extending laterally, and lines connecting the center line of the recessed portions 30, 31 to the opposite edges make an angle of 180 deg therebetween. The higher segmental cylindrical portions 32*a*, 33*a* of the peripheral walls 32, 33 of the recessed portions 30, 31 preferably have a height H1 of at least 10 mm, more preferably 10 to 15 mm, from the bottom surface of the recessed portion 30 or 31. The low segmental cylindrical portions 32*b*, 33*b* of the peripheral walls of the recessed portions 30, 31 preferably have a height H2 of at least 5 mm, more preferably 5 to 10 mm, from the bottom surface of the recessed portion 30 or 31. A projection 34 is formed integrally on the inner surface of each of the low cylindrical portions 32*b*, 33*b*. The projection 34 is made integral with the bottom surface of each recessed portion 30 or 31. The projection 34 fits into a cutout 18 or 28 formed in the end of each header 10 or 20, whereby each header 10 or 20 is positioned in place relative to the connector 3 circumferentially thereof.

Provided between the heat exchange tube 11 at the lower end of the oil cooler 1 and the heat exchange tube 21 at the upper end of the condenser 2 are a suitable number of aluminum separating plates 4 positioned in parallel to and spaced apart from these heat exchange tubes 11, 21. One separating aluminum plate 4 is used in the present embodiment. A corrugated aluminum fin 5 is disposed also between the separating plate 4 and each of the two heat exchange tubes 11, 21 and brazed to the plate 4 and the tube. Incidentally, the number of separating plate 4 is not limited only to one but is suitably variable. By suitably adjusting the thickness and number of separating plates 4, the spacing between the heat exchange tube 11 at the lower end of the oil cooler 1 and the heat exchange tube 21 at the upper end of the condenser 2 can be divided into at least two spacings equal to the spacing between the adjacent heat exchange tubes 11 and/or the spacing between the adjacent heat exchange tubes 21. This makes it possible to use the corrugated fin 12 of the oil cooler 1 and/or the corrugated fin 22 of the condenser 2 as corrugated fins 5. The heat of the oil flowing inside the heat exchange tube 11 at the lower end of the oil cooler 1 and the heat of the refrigerant flowing inside the heat exchange tube 21 at the upper end of the condenser 2 can be dissipated by the respective corrugated fins 5. This reduces the likelihood that each of the oil cooler 1 and the condenser 2 will be influenced by the heat of the other.

Aluminum side plates 19, 29 are arranged respectively above the heat exchange tube 11 at the upper end of the oil cooler 1 and below the heat exchange tube 21 at the lower end of the condenser 2. Corrugated aluminum fins 12, 22 are also provided between and brazed to the side plates 19, 29 and the heat exchange tubes 11, 21.

According to the present embodiment, the lower end of each header 10 of the oil cooler 1 and the upper end of each header 20 of the condenser 2 are joined to the connector 3, as fitted in the respective recessed portions 30, 31 of the connector 3. This obviates the likelihood that the oil of the oil cooler 1 will be mixed with the refrigerant of the condenser 2 to impair the performance of the heat exchange cycle including the condenser 2, or that the refrigerant of the condenser 2 will be mixed with the oil of the oil cooler 1 to adversely influence the performance of the device for which the oil is used.

The unit-type heat exchanger described is fabricated by assembling headers 10, heat exchange tubes 11, corrugated fins 12, oil inlet pipe 13, oil outlet pipe 14, partition plate 15, lids 16 and side plate 19 for making an oil cooler 1, headers 20, heat exchange tubes 21, corrugated fins 22, refrigerant inlet pipe 23, refrigerant outlet pipe 24, partition plates 25, 26, lids 27 and side plate 29 for making a condenser 2, connectors 3 and separating plate 4 as shown in FIG. 1, thereafter tacking the components by binding the assembly with suitable means so that upward and downward fastening forces and leftward and rightward fastening forces will act on the assembly and subsequently brazing all the components at the same time.

The oil cooler 1 of the unit-type heat exchange is used, for example, for cooling the oil for a power steering device.

Figure 4:
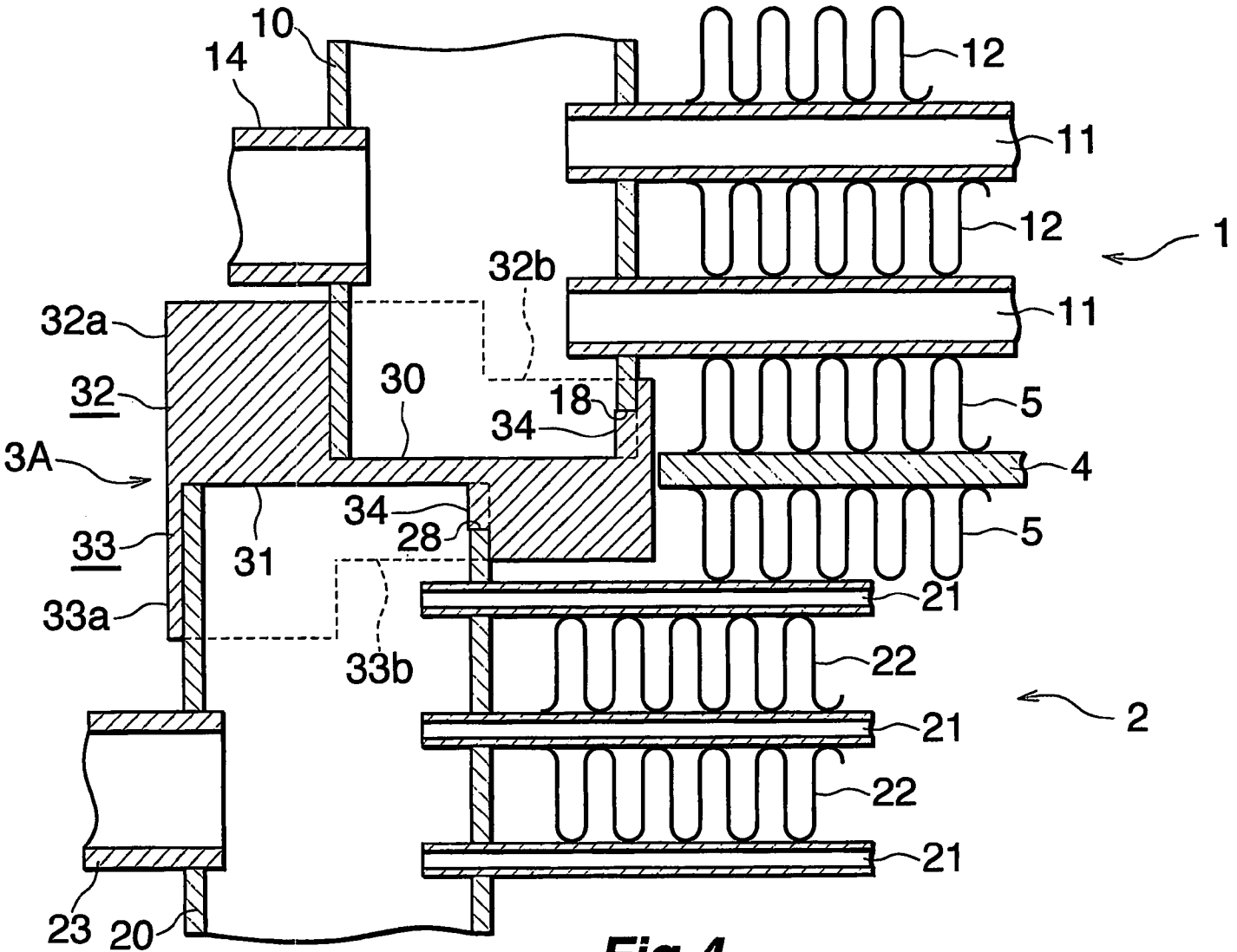
FIG. 4 is a view corresponding to FIG. 2 and showing a first modification of the connector.
Figure 5:
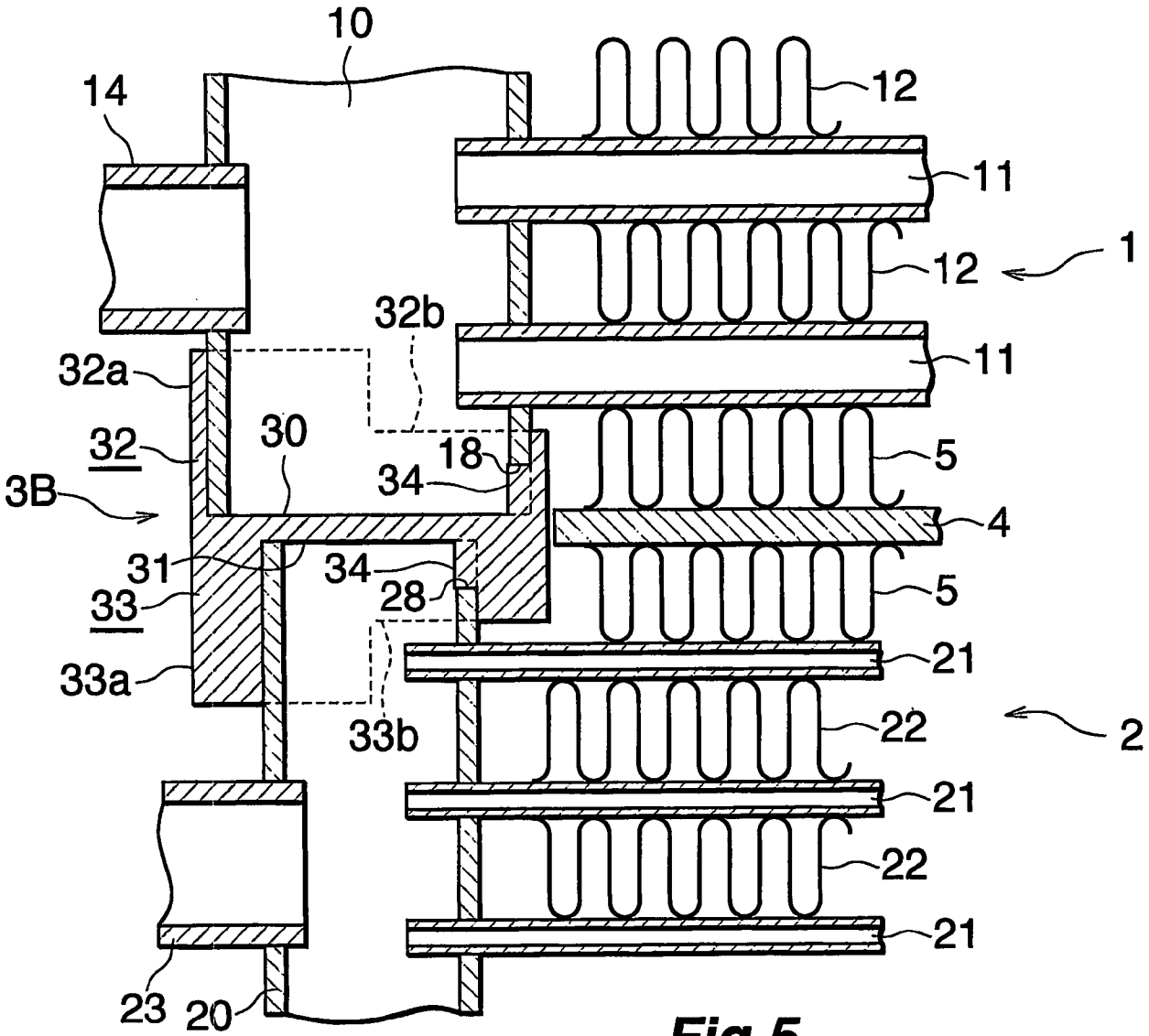
FIG. 5 is a view corresponding to FIG. 2 and showing a second modification of the connector.
Figure 6:
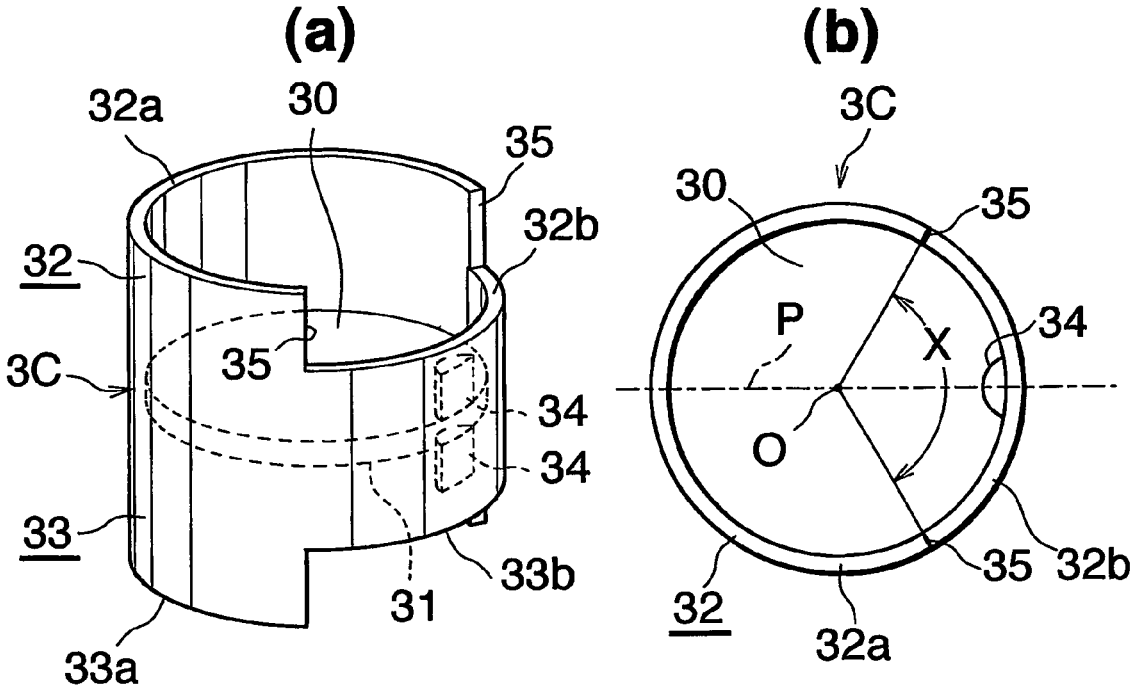
FIG. 6 shows a third modification of the connector, (a) being a perspective view, (b) being a plan view.

FIGS. 4 to 6 show modifications of the connector.

FIG. 4 shows a connector 3A having an upper recessed portion 30 and a lower recessed portion 31 which are in the same position with respect to the direction of flow of air (see an arrow A in FIG. 1). However, the upper recessed portion 30 is positioned laterally inwardly of the lower recessed portion 31, with the result that the center lines of the two recessed portions 30, 31 are in different positions laterally of the device. Incidentally, the upper and lower recessed portions 30, 31 have the same inside diameter. Accordingly, the length of the oil cooler 1 with respect to the lateral direction is shorter than that of the condenser 2. The resulting space available can then be utilized effectively for installing other components of the motor vehicle.

The connector otherwise has the same construction as the connector 3 shown in FIGS. 1 to 3.

Instead of shifting the upper recessed portion 30 and the lower recessed portion 31 relative to each other laterally in the connector 3A of FIG. 4, or in addition to this mode of shifting, the upper and lower recessed portions 30, 31 may be shifted relative to each other with respect to the direction of flow of air so as to position the center lines of the two recessed portions 30, 31 out of alignment with each other. Furthermore, the upper and lower recessed portions 30, 31 may be different in inside diameter.

FIG. 5 shows a connector 3B, wherein an upper recessed portion 30 is larger than a lower recessed portion 31 in inside diameter although the center lines of these recessed portions 30, 31 are in alignment. Accordingly, the header 10 of the oil cooler 1 is greater than the header 20 of the condenser 2 in outside diameter. This makes it possible to optimize the outside diameter of the header 10 in accordance with the performance required of the oil cooler 1 and the condenser 2.

The connector otherwise has the same construction as the connector 3 shown in FIGS. 1 to 3.

Instead of giving a larger inside diameter to the upper recessed portion 30 than to the lower recessed portion 31 in the connector 3B of FIG. 5, the lower recessed portion 31 may be made greater than the upper recessed portion 30 in inside diameter.

With reference to FIG. 6 showing a connector 3C, the peripheral walls 32, 33 of upper and lower recessed portions 30, 31 have laterally outer segmental cylindrical portions 32*a*, 33*a* of greater height which are each in the form of a superior arc when seen from above, and laterally inner segmental cylindrical portions 32*b*, 33*b* thereof are lower and are each similarly in the form of an inferior arc when seen from above. The higher segmental cylindrical portions 32*a*, 33*a* have opposite edges 35 which are positioned symmetrically about a horizontal plane P extending through the center line 0 of the recessed portions 30, 31 and extending laterally, and lines connecting the center line 0 of the recessed portions 30, 31 to the opposite edges 35 make an angle X of up to 120 deg therebetween. The lower limit of this angle X is such an angle that will not permit the edges 35 to contact heat exchange tubes 11, 21 of the oil cooler 1 and the condenser 2.

The connector otherwise has the same construction as the connector 3 shown in FIGS. 1 to 3.

When used, the connector 3C of FIG. 6 effectively prevents the headers 10, 20 from falling down when the components are tacked with the binding means in fabricating a unit-type heat exchanger by the process described above.

With the connector 3C shown in FIG. 6 as in the case of the connector 3A shown in FIG. 4, the upper recessed portion 30 and the lower recessed portion 31 may be shifted relative to each other laterally. Alternatively, instead of or in addition to lateral shifting, the upper and lower recessed portions 30, 31 may be shifted relative to each other with respect to the direction of flow of air so as to position the center lines of the two recessed portions 30, 31 out of alignment with each other. The upper and lower recessed portions 30, 31 may be different in inside diameter. Furthermore, as is the case with the connector 3B shown in FIG. 5, one of the upper and lower recessed portions 30, 31 may be made greater than the other in inside diameter, with the center lines of these recessed portions 30, 31 in alignment.

FIGS. 7 to 9 and FIGS. 10 to 15 show modifications of the separating plate.

Figure 7:
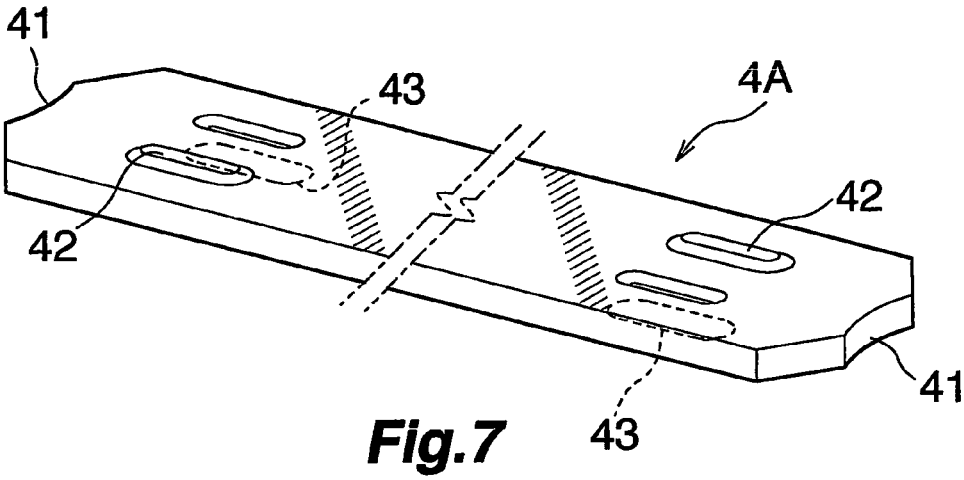
FIG. 7 is a perspective view showing a first modification of a separating plate with an intermediate portion thereof omitted.
Figure 8:
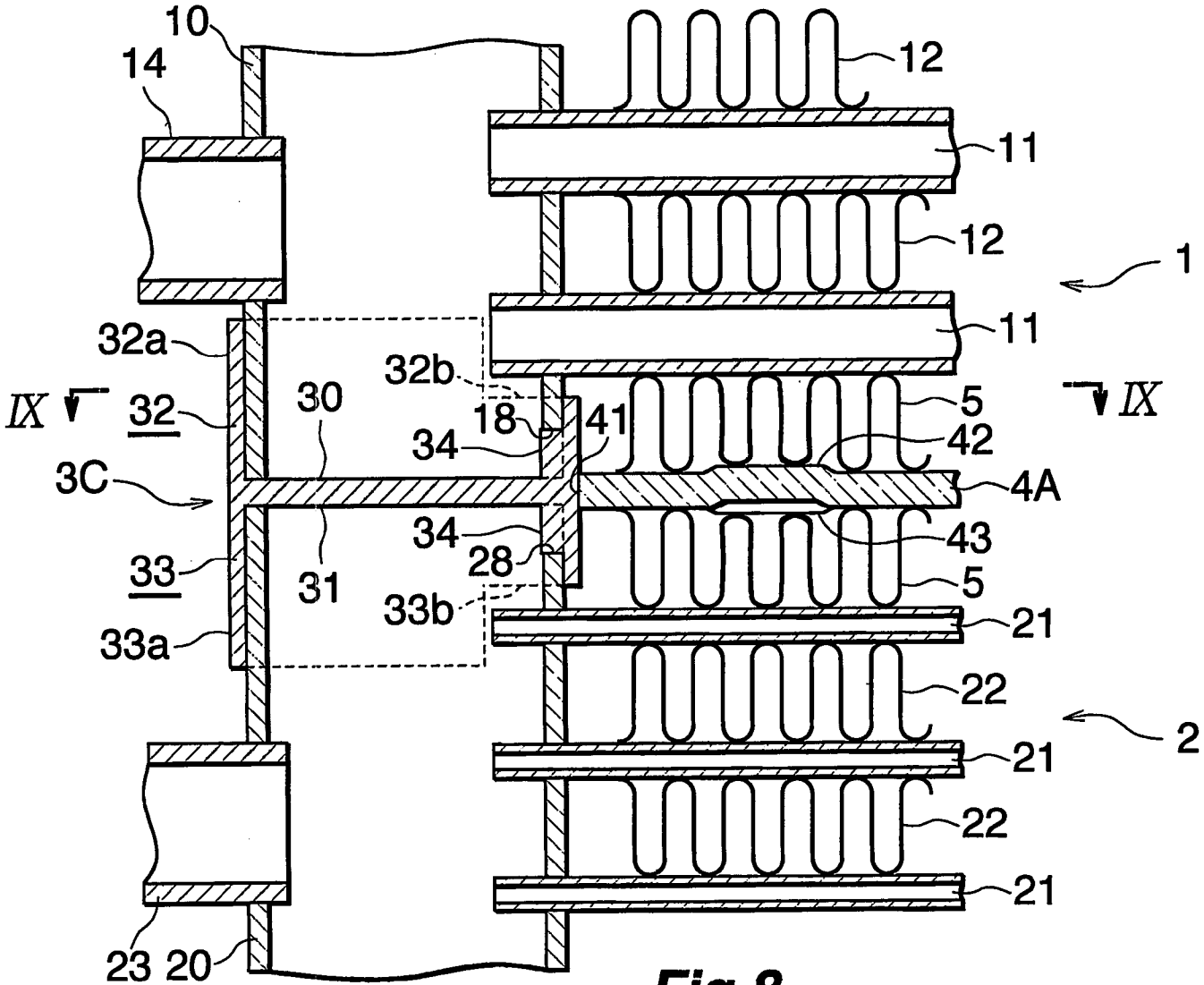
FIG. 8 is a view corresponding to FIG. 2 and showing a unit-type heat exchanger wherein the separating plate of FIG. 7 is used.
Figure 9:
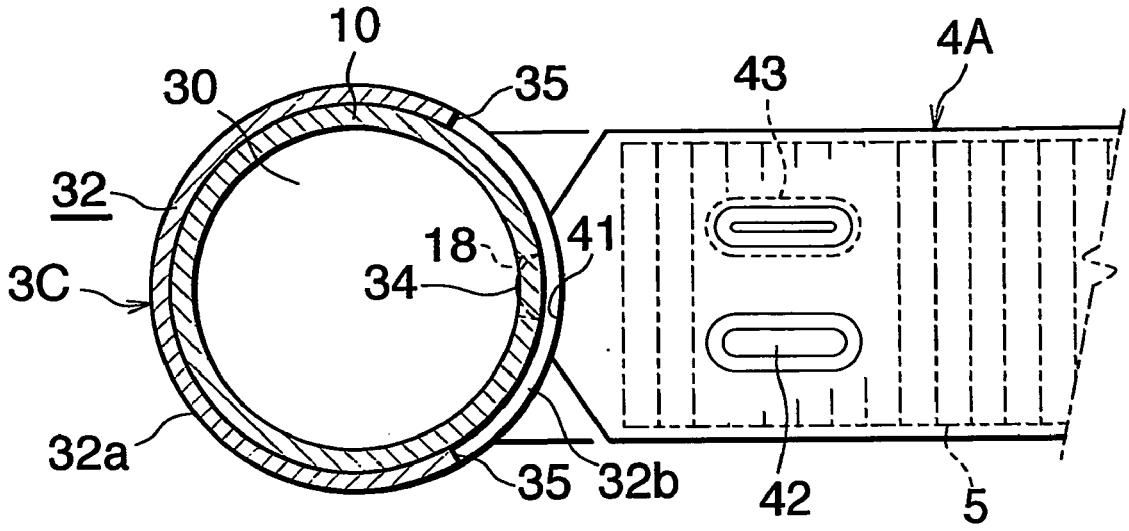
FIG. 9 is a view in section taken along the line IX—IX in FIG. 8.

FIGS. 7 to 9 show a separating plate 4A, which has opposite end portions each tapered toward an extremity with a gradually decreasing width. The separating plate 4A has circular-arc opposite end faces 41. The plate 4A is provided at each of opposite end portions thereof with an upward protrusion 42 and a downward protrusion 43 which are arranged in parallel in the direction of flow of air. These projections 42, 43 are each in a laterally elongated oblong form. The upward protrusion 42 at one end portion of the separating plate 4A and the downward protrusion 43 at the other end portion thereof are in the same position with respect to the direction of flow of air.

FIGS. 8 and 9 are fragmentary views showing a unit-type heat exchanger wherein the connector 3C of FIG. 6 is used.

As shown in FIGS. 8 and 9, the circular-arc opposite end faces 41 of the separating plate 4A have a curvature which is equal to the curvature of the outer peripheral surfaces of the peripheral walls 32, 33 of the connector 3C. Each circular-arc end face 41 of the separating plate 4A is in contact with the outer peripheral surface of the boundary between the two low segmental cylindrical portions 32*b*, 33*b* of the connector 3C.

When the separating plate 4A shown in FIGS. 7 to 9 is used in fabricating a unit-type heat exchanger by the process described, the headers 10, 20 can be supported by the higher segmental cylindrical portions 32*a*, 33*a* even if subjected to a laterally inward fastening force in the step of tacking the components with the binding means, and the contact of the circular-arc end face 41 of the separating plate 4A with the connector 3C reliably prevents the adjacent headers 10, 20, as supported by the connector 3C, from falling down laterally outward about the location of support by the connector 3C.

Figure 10:
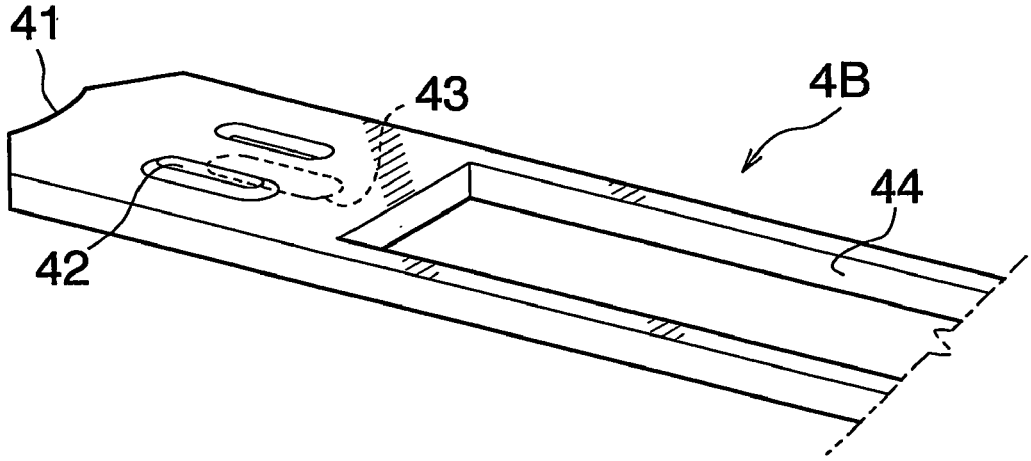
FIG. 10 is a fragmentary perspective view showing a second modification of the separating plate.

FIG. 10 shows a separating plate 4B, which has a laterally elongated hole 44 for reducing the area of contact of the plate with the corrugated fin 5. The hole 44 is formed in a portion of the plate other than the opposite end portions where the protrusions 42, 43 are formed.

Figure 11:
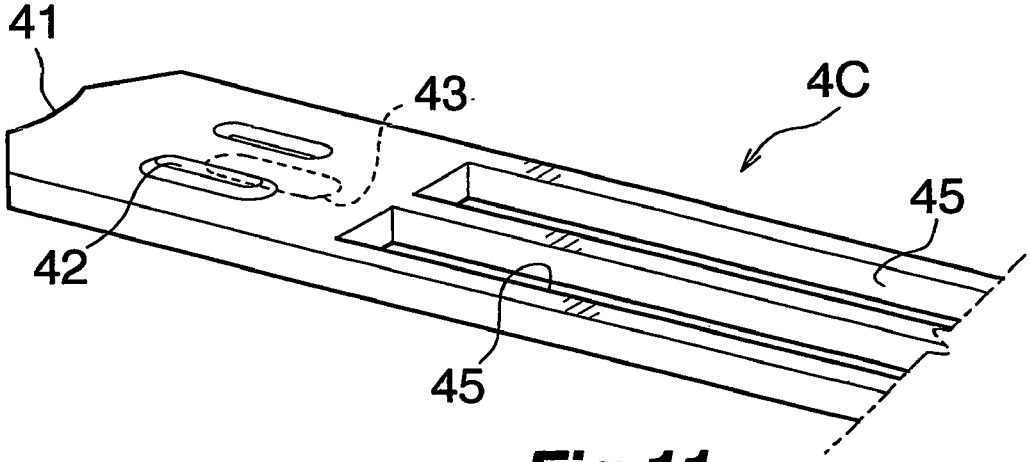
FIG. 11 is a fragmentary perspective view showing a third modification of the separating plate.

FIG. 11 shows a separating plate 4C, which has two laterally elongated holes 45 for reducing the area of contact of the plate with the corrugated fin 5. The holes 45 are spaced apart widthwise of the plate 4C and formed in plate portions other than the opposite end portions where the protrusions 42, 43 are formed.

Figure 12:
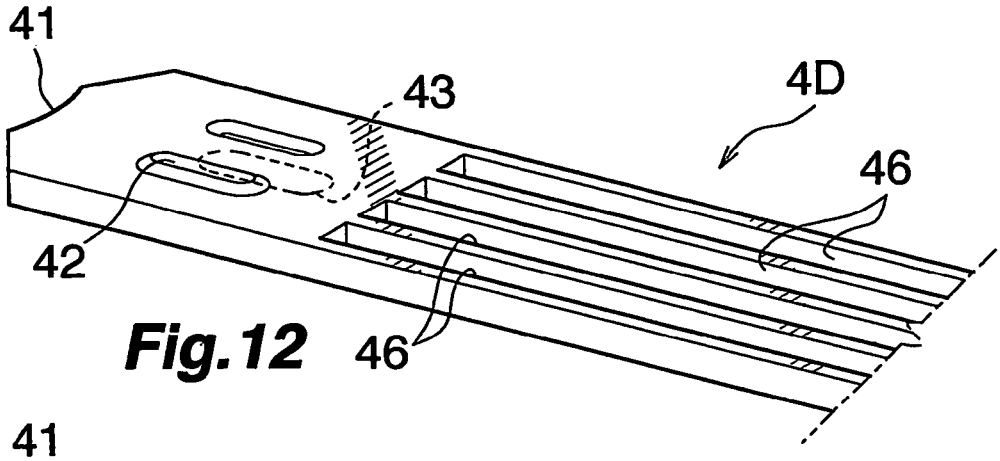
FIG. 12 is a fragmentary perspective view showing a fourth modification of the separating plate.

FIG. 12 shows a separating plate 4D, which has at least three laterally elongated holes 46 for reducing the area of contact of the plate with the corrugated fin 5. The present modification has four holes 46 spaced apart widthwise of the plate 4D and formed in plate portions other than the opposite end portions where the protrusions 42, 43 are formed.

Figure 13:
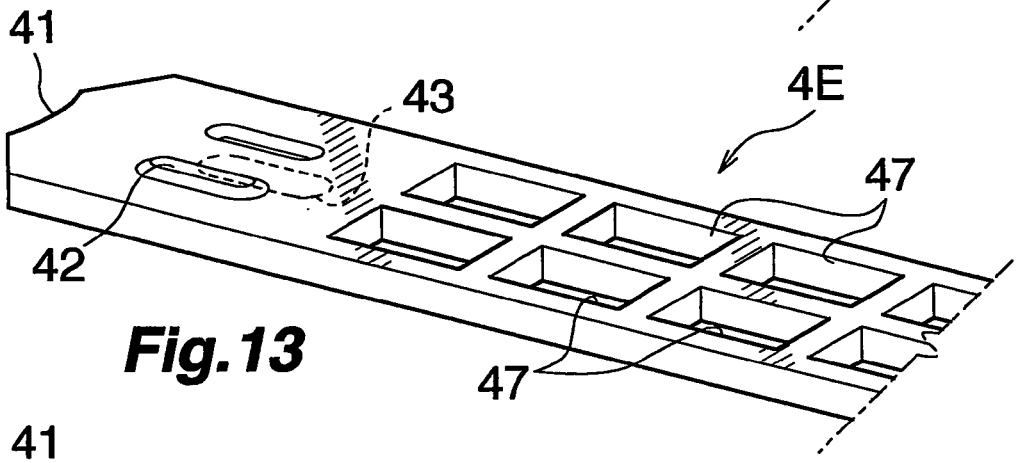
FIG. 13 is a fragmentary perspective view showing a fifth modification of the separating plate.

FIG. 13 shows a separating plate 4E, which has a plurality of holes 47 for reducing the area of contact of the plate with the corrugated fin 5. The holes 47 are arranged in rows both lengthwise and widthwise of the plate 4E and formed in plate portions other than the opposite end portions where the protrusions 42, 43 are formed.

Figure 14:
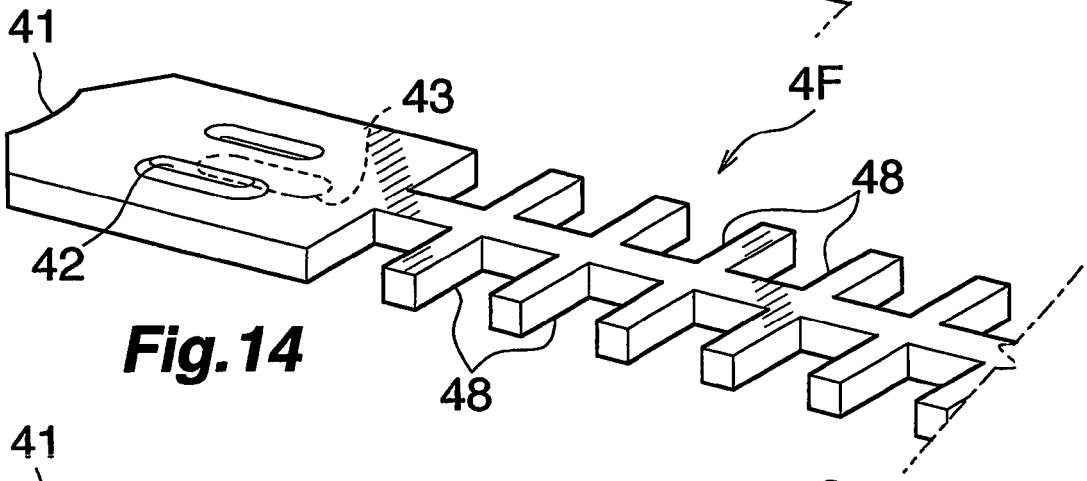
FIG. 14 is a fragmentary perspective view showing a sixth modification of the separating plate.

FIG. 14 shows a separating plate 4F, which has a plurality of cutouts 48 formed in each of opposite side edges thereof and spaced apart longitudinally of the plate 4F. The cutouts 48 in one of the side edges are respectively in the same positions as the cutouts 48 in the other side edges with respect to the longitudinal direction of the plate 4F.

Figure 15:
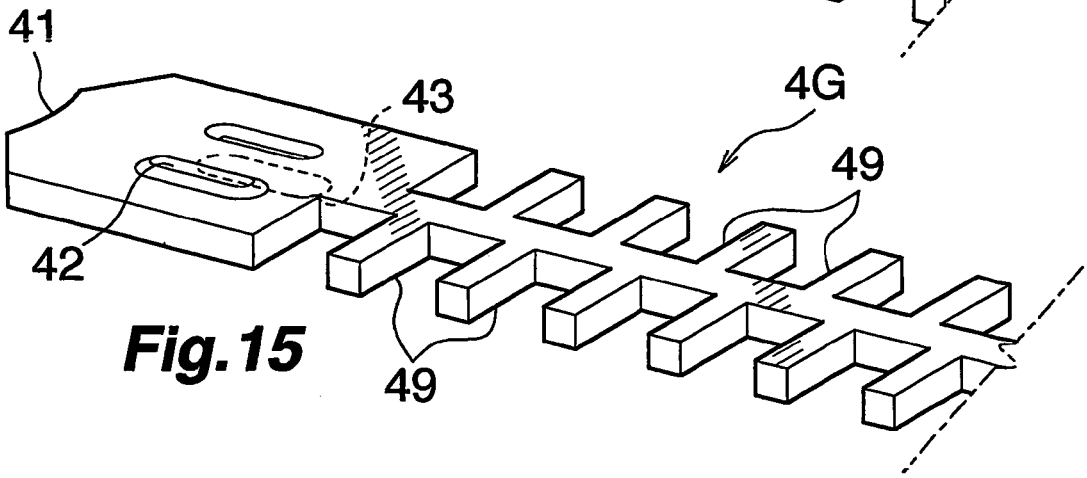
FIG. 15 is a fragmentary perspective view showing a seventh modification of the separating plate.

FIG. 15 shows a separating plate 4G, which has a plurality of cutouts 49 formed in each of opposite side edges thereof and spaced apart longitudinally of the plate 4G. The cutouts 49 in one of the side edges are positioned as shifted from the cutouts 49 in the other side edges with respect to the longitudinal direction of the plate 4G.

The separating plates 4B to 4G shown in FIGS. 10 to 15 otherwise have the same construction as the separating plate 4A shown in FIG. 7 to 9.

In the case of unit-type heat exchangers wherein the respective separating plates 4B to 4G shown in FIGS. 10 to 15 are used, each of the separating plates 4B to 4G is in contact with the corrugated fin 5 over a reduced area, permitting transfer of a smaller quantity of heat between these components. The heat of the oil flowing through the heat exchange tube 11 at the lower end of the oil cooler 1 is therefore less likely to be transferred to the fluid flowing through the heat exchange tube 21 at the upper end of the condenser 2.

Figure 16:
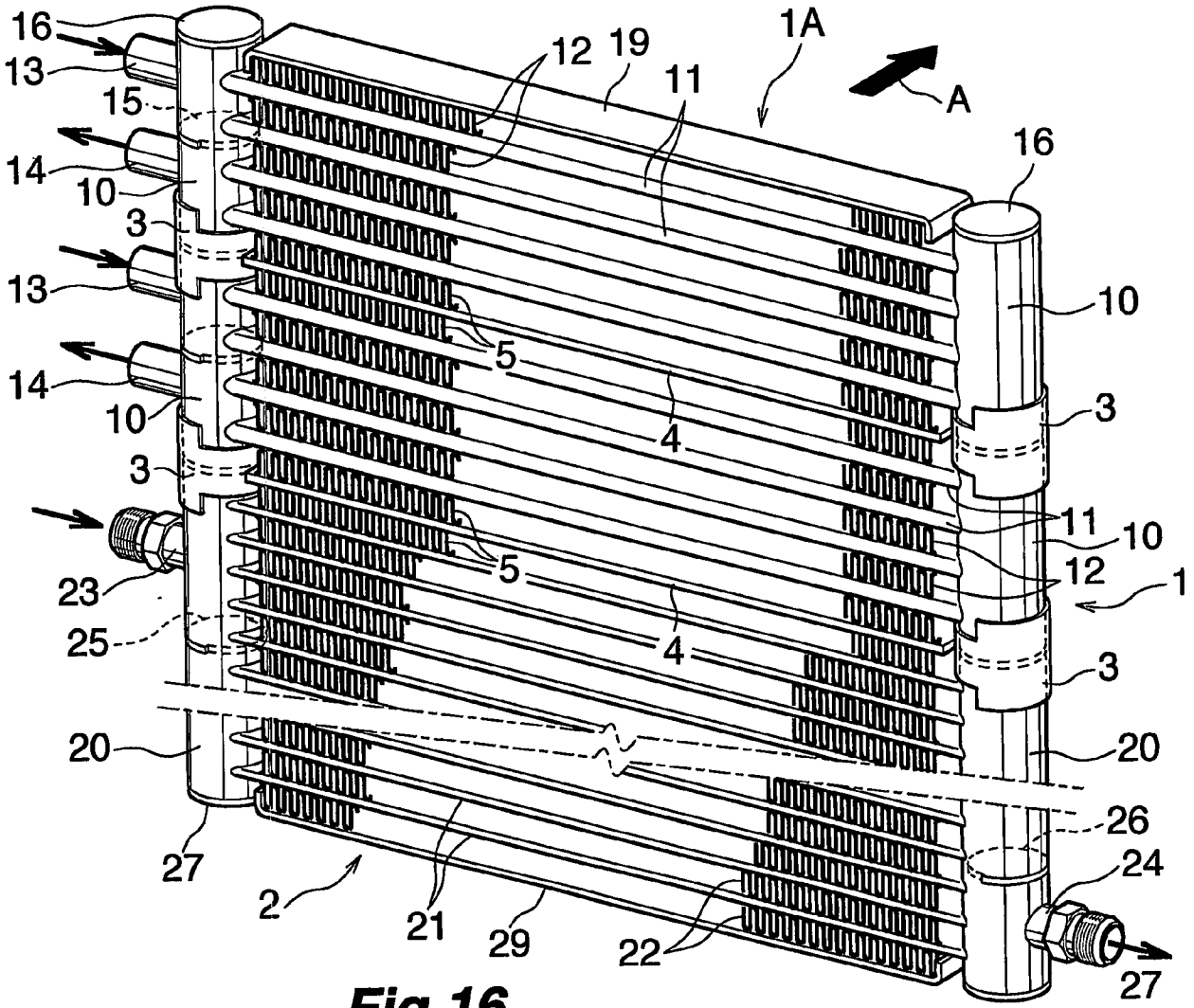
FIG. 16 is a perspective view showing the overall construction of another embodiment of unit-type heat exchanger according to the invention.

FIG. 16 shows the overall construction of another embodiment of unit-type heat exchanger according to the present invention.

With reference to FIG. 16, provided above an oil cooler 1 is an oil cooler 1A having the same construction as the cooler 1 and positioned in the same vertical plane as the cooler 1.

The headers 10 of the two oil coolers 1, 1A at each of the left and right ends of the exchanger are connected by a connector 3. An upper-end opening of the header 10 of the lower oil cooler 1 and a lower-end opening of the header 10 of the upper cooler 1A are closed with the connector 3. An upper-end opening of the header 10 of the upper oil cooler 1A is closed with a lid 16.

Provided between a heat exchange tube 11 at the lower end of the upper oil cooler 1A and a heat exchange tube 11 at the upper end of the lower oil cooler 1 is an aluminum separating plate 4 positioned in parallel to and spaced apart from these heat exchange tubes 11, 11. A corrugated aluminum fin 5 is disposed between the separating plate 4 and each of the two heat exchange tubes 11, 11 and brazed to the plate 4 and the tube 11. Incidentally, the number of separating plate 4 is not limited only to one but is suitably variable.

The upper oil cooler 1A is used for cooling an oil different from the oil to be cooled by the lower oil cooler 1, such as engine oil or oil for automatic transmissions.

With the two unit-type heat exchangers described, the headers 10, 20 of the oil cooler 1 and the condenser 2 are circular in cross section, whereas the headers need not always be so shaped but can be, for example, rectangular or elliptical in cross section. In this case, the two recessed portions of the connector as seen from above and below, respectively, are given the same cross sectional shape as the headers.

In the two unit-type heat exchangers described, the oil cooler 1 has two channel groups, through which the oil flows in a hairpin pattern. However, the number of channel groups is not limited to two but is variable suitably. For example, the cooler may have one channel group for the oil to flow straight therethrough from one header 10 to the other header 10, or at least three channel groups may be provided for the oil to flow zigzag therethrough. Although the condenser 2 has three channel groups for the refrigerant to flow zigzag therethrough, this mode of flow is not limitative; the number of channel groups is variable suitably. For example, one channel group may be provided, permitting the refrigerant to flow straight therethrough from one header 20 to the other header 20, or two channel groups may be provided for the refrigerant to flow therethrough in a hairpin pattern. Alternatively, at least four channel groups may be provided, permitting the refrigerant to flow zigzag therethrough.

The two unit-type heat exchangers described comprise an oil cooler 1 and a condenser 2 for motor vehicle air conditioners which are assembled into a unit for use in motor vehicles, whereas these components of the exchanger are not limitative: two or three heat exchange portions may be selected from among oil coolers for various oils for use in motor vehicle engines, power steering devices, automatic transmissions and like devices, condensers for motor vehicle air conditioners and automotive radiators, and assembled into a unit. The unit-type heat exchanger of the present invention is not limited to use in motor vehicles but is usable also in industrial machines. For example, an oil cooler and a charge air cooler for use in load compressors may be assembled into a unit.

Although the two unit-type heat exchangers described have two or three heat exchange portions, the number of heat exchange portions may be at least four.

INDUSTRIAL APPLICABILITY

With the unit-type heat exchanger of the invention, one of the heat exchange portions is suitable for use as a compressor for motor vehicle air conditioners, and the other heat exchange portion is suited for use as an oil cooler for motor vehicle engine oils, oils for power steering devices, automatic transmission oils and the like.

The invention claimed is:

1. A unit-type heat exchangers comprising:

a plurality of heat exchange portions each comprising two headers arranged in parallel to each other and spaced apart, a plurality of heat exchange tubes arranged in parallel to each other and joined at opposite ends thereof to the two headers, and a plurality of fins disposed in air passing spaces between the heat exchange tubes, respectively, the heat exchange portions being arranged longitudinally of the headers;

a plurality of connectors connecting adjacent ones of the heat exchanging portions via the headers, each of the connectors having a plurality of recessed portions at opposite side thereof, the recessed portions being configured to be fitted with ends of the headers, respectively; and at least one separating plate disposed between adjacent ones of the heat exchanging portions and arranged parallel to the heat exchange tubes, the separating plate having opposite ends each in contact with respective ones of the connectors.

2. A unit-type heat exchanger according to claim 1, wherein the air passing spaces in each of the heat exchange portions have a spacing equal to each other, the at least one separating plate forms at least two spacings sandwiched between the heat exchange tubes of adjacent ones of the heat exchange portions, and each of the at least two spacing formed by the at least one separating plate is equal to at least one of the spacing of the air passing spaces in the adjacent ones of the heat exchange portions and has a fin disposed therein.

3. A unit-type heat exchanger according to claim 1, wherein each of the recessed portions in each of the connectors has a peripheral wall having a high portion and a low portion such that the low portion is positioned not to interfere with arrangement of the heat exchange tubes, and the high portion extends greater than the low portion in height as measured from a bottom surface of each of the recessed portions.

4. A unit-type heat exchanger according to claim 3, wherein the high portion of the peripheral wall in each of the recessed portions has a height of at least 10 mm as measured from the bottom surface of each of the recessed portions.

5. A unit-type heat exchanger according to claim 3, wherein the low portion of the peripheral wall of each of the recessed portions has a small height of at least 5 mm as measured from the bottom surface of each of the recessed portions.

6. A unit-type heat exchanger according to claim 3, wherein the high portion of the peripheral wall of each of the recessed portions has opposite edges which are positioned symmetrically about a plane extending through the center of each of the recessed portions and extending longitudinally of the heat exchange tubes, and lines connecting the center of each of the recessed portions to the opposite edges make an angle of 180 degree therebetween.

7. A unit-type heat exchanger according to claim 3, wherein the high portion of the peripheral wall of each of the recessed portions has opposite edges which are positioned symmetrically about a plane extending through the center of each of the recessed portions and extending longitudinally of the heat exchange tubes, and lines connecting the center of each of the recessed portions to the opposite edges make an angle of 120 degree therebetween.

8. A unit-type heat exchanger according to claim 1, wherein the recessed portions of each of the connectors are different in size, and the headers of adjacent ones of the heat exchange portions are different in cross sectional size.

9. A unit-type heat exchanger according to claim 1, wherein center lines of the recessed portions of each of the connectors are out of alignment with each other, and center lines of the headers of adjacent ones of the heat exchange portions are out of alignment with each other.

10. A unit-type heat exchanger according to claim 1, wherein each of the recessed portions in each of the connectors has a projection formed on an inner peripheral surface thereof, a peripheral wall of each of the headers has a cutout formed in an end portion thereof, and the cutout in the peripheral wall of each of the headers is configured to fit the projection formed in each of the recessed portions therein.

11. A unit-type heat exchanger according to claim 1, wherein the plurality of heat exchange portions comprises two heat exchange portions, one of the two heat exchange portions comprises a condenser, and the other one of the two heat exchange portions comprises an oil cooler.

12. A unit-type heat exchanger according to claim 1, wherein the plurality of heat exchange portions comprises three heat exchange portions, one of the three heat exchange portions comprises a condenser, the other two heat exchange portions comprise oil coolers, and the oil coolers are configured to cool oils for different uses.

13. A unit-type heat exchangers comprising:

a plurality of heat exchange portions each comprising two headers arranged in parallel to each other and spaced apart, a plurality of heat exchange tubes arranged in parallel to each other and joined at opposite ends thereof to the two headers, and a plurality of fins disposed in air passing spaces between the heat exchange tubes, respectively, the heat exchange portions being arranged longitudinally of the headers;

a plurality of connectors connecting adjacent ones of the heat exchanging portions via the headers, each of the connectors having a plurality of recessed portions at opposite side thereof, the recessed portions being configured to be fitted with ends of the headers, respectively; and at least one separating plate disposed between adjacent ones of the heat exchanging portions and arranged parallel to the heat exchange tubes, the separating plate having opposite end portions each tapered toward respective ones of the connectors with a deceasing width.

14. A unit-type heat exchanger according to claim 13, wherein the air passing spaces in each of the heat exchange portions have a spacing equal to each other, the at least one separating plate forms at least two spacings sandwiched between the heat exchange tubes of adjacent ones of the heat exchange portions, and each of the at least two spacing formed by the at least one separating plate is equal to at least one of the spacing of the air passing spaces in the adjacent ones of the heat exchange portions and has a fin disposed therein.

15. A unit-type heat exchanger according to claim 13, wherein each of the recessed portions in each of the connectors has a peripheral wall having a high portion and a low portion such that the low portion is positioned not to interfere with arrangement of the heat exchange tubes, and the high portion extends greater than the low portion in height as measured from a bottom surface of each of the recessed portions.

16. A unit-type heat exchanger according to claim 15, wherein the high portion of the peripheral wall in each of the recessed portions has a height of at least 10 mm as measured from the bottom surface of each of the recessed portions.

17. A unit-type heat exchanger according to claim 15, wherein the low portion of the peripheral wall of each of the recessed portions has a small height of at least 5 mm as measured from the bottom surface of each of the recessed portions.

18. A unit-type heat exchanger according to claim 15, wherein the high portion of the peripheral wall of each of the recessed portions has opposite edges which are positioned symmetrically about a plane extending through the center of each of the recessed portions and extending longitudinally of the heat exchange tubes, and lines connecting the center of each of the recessed portions to the opposite edges make an angle of 180 degree therebetween.

19. A unit-type heat exchanger according to claim 15, wherein the high portion of the peripheral wall of each of the recessed portions has opposite edges which are positioned symmetrically about a plane extending through the center of each of the recessed portions and extending longitudinally of the heat exchange tubes, and lines connecting the center of each of the recessed portions to the opposite edges make an angle of 120 degree therebetween.

20. A unit-type heat exchanger according to claim 13, wherein the recessed portions of each of the connectors are different in size, and the headers of adjacent ones of the heat exchange portions are different in cross sectional size.

21. A unit-type heat exchanger according to claim 13, wherein center lines of the recessed portions of each of the connectors are out of alignment with each other, and center lines of the headers of adjacent ones of the heat exchange portions are out of alignment with each other.

22. A unit-type heat exchanger according to claim 13, wherein each of the recessed portions in each of the connectors has a projection formed on an inner peripheral surface thereof, a peripheral wall of each of the headers has a cutout formed in an end portion thereof, and the cutout in the peripheral wall of each of the headers is configured to fit the projection formed in each of the recessed portions therein.

23. A unit-type heat exchanger according to claim 13, wherein the plurality of heat exchange portions comprises two heat exchange portions, one of the two heat exchange portions comprises a condenser, and the other one of the two heat exchange portions comprises an oil cooler.

24. A unit-type heat exchanger according to claim 13, wherein the plurality of heat exchange portions comprises three heat exchange portions, one of the three heat exchange portions comprises a condenser, the other two heat exchange portions comprise oil coolers, and the oil coolers are configured to cool oils for different uses.

25. A unit-type heat exchangers comprising:

a plurality of heat exchange portions each comprising two headers arranged in parallel to each other and spaced apart, a plurality of heat exchange tubes arranged in parallel to each other and joined at opposite ends thereof to the two headers, and a plurality of fins disposed in air passing spaces between the heat exchange tubes, respectively, the heat exchange portions being arranged longitudinally of the headers;

a plurality of connectors connecting adjacent ones of the heat exchanging portions via the headers, each of the connectors having a plurality of recessed portions at opposite side thereof, the recessed portions being configured to be fitted with ends of the headers, respectively; and at least one separating plate disposed between adjacent ones of the heat exchanging portions and arranged parallel to the heat exchange tubes, wherein the separating plate has opposite end portions each provided with a protrusion on each of opposite surfaces thereof.

26. A unit-type heat exchanger according to claim 25, wherein the air passing spaces in each of the heat exchange portions have a spacing equal to each other, the at least one separating plate forms at least two spacings sandwiched between the heat exchange tubes of adjacent ones of the heat exchange portions, and each of the at least two spacing formed by the at least one separating plate is equal to at least one of the spacing of the air passing spaces in the adjacent ones of the heat exchange portions and has a fin disposed therein.

27. A unit-type heat exchanger according to claim 25, wherein each of the recessed portions in each of the connectors has a peripheral wall having a high portion and a low portion such that the low portion is positioned not to interfere with arrangement of the heat exchange tubes, and the high portion extends greater than the low portion in height as measured from a bottom surface of each of the recessed portions.

28. A unit-type heat exchanger according to claim 27, wherein the high portion of the peripheral wall in each of the recessed portions has a height of at least 10 mm as measured from the bottom surface of each of the recessed portions.

29. A unit-type heat exchanger according to claim 27, wherein the low portion of the peripheral wall of each of the recessed portions has a small height of at least 5 mm as measured from the bottom surface of each of the recessed portions.

30. A unit-type heat exchanger according to claim 27, wherein the high portion of the peripheral wall of each of the recessed portions has opposite edges which are positioned symmetrically about a plane extending through the center of each of the recessed portions and extending longitudinally of the heat exchange tubes, and lines connecting the center of each of the recessed portions to the opposite edges make an angle of 180 degree therebetween.

31. A unit-type heat exchanger according to claim 27, wherein the high portion of the peripheral wall of each of the recessed portions has opposite edges which are positioned symmetrically about a plane extending through the center of each of the recessed portions and extending longitudinally of the heat exchange tubes, and lines connecting the center of each of the recessed portions to the opposite edges make an angle of 120 degree therebetween.

32. A unit-type heat exchanger according to claim 25, wherein the recessed portions of each of the connectors are different in size, and the headers of adjacent ones of the heat exchange portions are different in cross sectional size.

33. A unit-type heat exchanger according to claim 25, wherein center lines of the recessed portions of each of the connectors are out of alignment with each other, and center lines of the headers of adjacent ones of the heat exchange portions are out of alignment with each other.

34. A unit-type heat exchanger according to claim 25, wherein each of the recessed portions in each of the connectors has a projection formed on an inner peripheral surface thereof, a peripheral wall of each of the headers has a cutout formed in an end portion thereof, and the cutout in the peripheral wall of each of the headers is configured to fit the projection formed in each of the recessed portions therein.

35. A unit-type heat exchanger according to claim 25, wherein the plurality of heat exchange portions comprises two heat exchange portions, one of the two heat exchange portions comprises a condenser, and the other one of the two heat exchange portions comprises an oil cooler.

36. A unit-type heat exchanger according to claim 25, wherein the plurality of heat exchange portions comprises three heat exchange portions, one of the three heat exchange portions comprises a condenser, the other two heat exchange portions comprise oil coolers, and the oil coolers are configured to cool oils for different uses.

37. A unit-type heat exchangers comprising:

a plurality of heat exchange portions each comprising two headers arranged in parallel to each other and spaced apart, a plurality of heat exchange tubes arranged in parallel to each other and joined at opposite ends thereof to the two headers, and a plurality of fins disposed in air passing spaces between the heat exchange tubes, respectively, the heat exchange portions being arranged longitudinally of the headers;

a plurality of connectors connecting adjacent ones of the heat exchanging portions via the headers, each of the connectors having a plurality of recessed portions at opposite side thereof, the recessed portions being configured to be fitted with ends of the headers, respectively; and at least one separating plate disposed between adjacent ones of the heat exchanging portions and arranged parallel to the heat exchange tubes, the separating plate has at least one hole or cutout portion between opposite end portions, the at least one hole or cutout portion being configured to reduce a contact area of the separating plate with the fin.

38. A unit-type heat exchanger according to claim 37, wherein the air passing spaces in each of the heat exchange portions have a spacing equal to each other, the at least one separating plate forms at least two spacings sandwiched between the heat exchange tubes of adjacent ones of the heat exchange portions, each of the at least two spacing formed by the at least one separating plate is equal to at least one of the spacing of the air passing spaces in the adjacent ones of the heat exchange portions and has a fin disposed therein.

39. A unit-type heat exchanger according to claim 37, wherein each of the recessed portions in each of the connectors has a peripheral wall having a high portion and a low portion such that the low portion is positioned not to interfere with arrangement of the heat exchange tubes, and the high portion extends greater than the low portion in height as measured from a bottom surface of each of the recessed portions.

40. A unit-type heat exchanger according to claim 39, wherein the high portion of the peripheral wall in each of the recessed portions has a height of at least 10 mm as measured from the bottom surface of each of the recessed portions.

41. A unit-type heat exchanger according to claim 39, wherein the low portion of the peripheral wall of each of the recessed portions has a small height of at least 5 mm as measured from the bottom surface of each of the recessed portions.

42. A unit-type heat exchanger according to claim 39, wherein the high portion of the peripheral wall of each of the recessed portions has opposite edges which are positioned symmetrically about a plane extending through the center of each of the recessed portions and extending longitudinally of the heat exchange tubes, and lines connecting the center of each of the recessed portions to the opposite edges make an angle of 180 degree therebetween.

43. A unit-type heat exchanger according to claim 39, wherein the high portion of the peripheral wall of each of the recessed portions has opposite edges which are positioned symmetrically about a plane extending through the center of each of the recessed portions and extending longitudinally of the heat exchange tubes, and lines connecting the center of each of the recessed portions to the opposite edges make an angle of 120 degree therebetween.

44. A unit-type heat exchanger according to claim 37, wherein the recessed portions of each of the connectors are different in size, and the headers of adjacent ones of the heat exchange portions are different in cross sectional size.

45. A unit-type heat exchanger according to claim 37, wherein center lines of the recessed portions of each of the connectors are out of alignment with each other, and center lines of the headers of adjacent ones of the heat exchange portions are out of alignment with each other.

46. A unit-type heat exchanger according to claim 37, wherein each of the recessed portions in each of the connectors has a projection formed on an inner peripheral surface thereof, a peripheral wall of each of the headers has a cutout formed in an end portion thereof, and the cutout in the peripheral wall of each of the headers is configured to fit the projection formed in each of the recessed portions therein.

47. A unit-type heat exchanger according to claim 37, wherein the plurality of heat exchange portions comprises two heat exchange portions, one of the two heat exchange portions comprises a condenser, and the other one of the two heat exchange portions comprises an oil cooler.

48. A unit-type heat exchanger according to claim 37, wherein the plurality of heat exchange portions comprises three heat exchange portions, one of the three heat exchange portions comprises a condenser, the other two heat exchange portions comprise oil coolers, and the oil coolers are configured to cool oils for different uses.

49. A vehicle comprising the unit-type heat exchanger according to any one of claims 1, 13, 25 or 37.

* * * * *